US011662062B2

(12) United States Patent
Riley et al.

(10) Patent No.: US 11,662,062 B2
(45) **Date of Patent: *May 30, 2023**

(54) SYSTEMS AND METHODS FOR CONTROLLING PRESSURE IN A CRYOGENIC ENERGY STORAGE SYSTEM

(71) Applicant: Highview Enterprises Limited, London (GB)

(72) Inventors: Richard Riley, London (GB); Miriam Zubizarreta, London (GB); Nicola Castellucci, Woking Surrey (GB); Paul Currie, Lancing West Sussex (GB)

(73) Assignee: Highview Enterprises Limited, England (GB)

( * ) Notice: Subject to any disclaimer, the term of this patent is extended or adjusted under 35 U.S.C. 154(b) by 51 days.

This patent is subject to a terminal disclaimer.

(21) Appl. No.: 17/208,573

(22) Filed: Mar. 22, 2021

(65) Prior Publication Data

US 2021/0207774 A1 Jul. 8, 2021

Related U.S. Application Data

(63) Continuation of application No. 15/572,095, filed as application No. PCT/GB2016/051321 on May 9, 2016, now Pat. No. 10,955,090.

(30) Foreign Application Priority Data

May 7, 2015 (GB) ..... 1507836

(51) Int. Cl.
*F17C 9/00* (2006.01)
*F17C 9/04* (2006.01)

(52) U.S. Cl.
CPC ..... *F17C 9/04* (2013.01); *F17C 2221/011* (2013.01); *F17C 2221/014* (2013.01);
(Continued)

(58) Field of Classification Search
CPC ..... F17C 9/02; F17C 9/04; F17C 2227/0107
See application file for complete search history.

(56) References Cited

U.S. PATENT DOCUMENTS 4,995,234 A * 2/1991 Kooy ..... F01K 25/10 60/659
6,112,528 A * 9/2000 Rigby ..... F17C 7/04 62/48.1
2017/0038008 A1* 2/2017 Tada ..... F02C 1/02

* cited by examiner

*Primary Examiner* — Brian M King
(74) *Attorney, Agent, or Firm* — Andrew J. Anderson, Esq.; Harter Secrest & Emery LLP

(57) ABSTRACT

A cryogenic energy storage system comprises at least one cryogenic fluid storage tank having an output; a primary conduit through which a stream of cryogenic fluid may flow from the output of the fluid storage tank to an exhaust; a pump within the primary conduit downstream of the output of the tank for pressurising the cryogenic fluid stream; evaporative means within the primary conduit downstream of the pump for vaporising the pressurised cryogenic fluid stream; at least one expansion stage within the primary conduit downstream of the evaporative means for expanding the vaporised cryogenic fluid stream and for extracting work therefrom; a secondary conduit configured to divert at least a portion of the cryogenic fluid stream from the primary conduit and reintroduce it to the fluid storage tank; and pressure control means within the secondary conduit for controlling the flow of the diverted cryogenic fluid stream and thereby controlling the pressure within the tank. The secondary conduit is coupled to the primary conduit downstream of one or more of the at least one expansion stages.

18 Claims, 5 Drawing Sheets

(52) U.S. Cl.
CPC ..... *F17C 2221/033* (2013.01); *F17C 2223/0161* (2013.01); *F17C 2223/033* (2013.01); *F17C 2223/035* (2013.01); *F17C 2227/0107* (2013.01); *F17C 2227/0135* (2013.01); *F17C 2227/0304* (2013.01); *F17C 2227/0309* (2013.01); *F17C 2227/0339* (2013.01); *F17C 2227/0358* (2013.01); *F17C 2227/0365* (2013.01); *F17C 2250/03* (2013.01); *F17C 2250/043* (2013.01); *F17C 2250/0626* (2013.01); *F17C 2250/0636* (2013.01); *F17C 2260/046* (2013.01); *F17C 2265/07* (2013.01); *F17C 2270/02* (2013.01); *F17C 2270/05* (2013.01); *F17C 2270/0581* (2013.01)

SYSTEMS AND METHODS FOR CONTROLLING PRESSURE IN A CRYOGENIC ENERGY STORAGE SYSTEM

FIELD OF THE INVENTION

The present invention relates to cryogenic energy storage systems and methods for operating the same, and particularly to the control of pressure in the sub-systems thereof.

BACKGROUND OF THE INVENTION

The bulk storage of cryogenic liquids is achieved using pressurised, insulated vessels held at low pressure, usually below 10 bar. Typical examples include the storage of natural gas as Liquid Natural Gas and the storage in liquid form of industrial gases such as nitrogen and oxygen for industrial or medical applications.

Common to all bulk cryogenic storage applications is the requirement to dispense the fluid to a consumer. In the case of Liquid Natural Gas this is often a gas distribution pipeline or a power station. In the case of industrial gases this may be a manufacturing process or a bottle filling facility.

Cryogenic liquid is usually withdrawn from the storage tank using a pump, which conveys the fluid to the consumer. The pressure to which the pump raises the fluid is determined by the delivery pressure required by the consumer, taking into account any losses such as pressure drop in the pipes and the maintenance of the fluid in the desired thermodynamic state (typically in the liquid phase, away from the liquid-vapour saturation curve—i.e. in a subcooled state).

In some cases, where delivery rate is particularly low, the outflow of cryogenic liquid from the tank may be driven by the pressure in the headspace of the tank, without the need for a pump.

Where the consumer requires the fluid in gaseous form, the cryogenic liquid is then evaporated by the addition of heat.

As with any liquid pump, the net positive suction pressure head (NPSH) is of primary importance for the cryogenic liquid delivery pump of a cryogenic liquid storage system. The NPSH represents the reduction in pressure as the liquid is sucked into the inlet of the pump. A further pressure reduction is associated with frictional (or 'major') and component (or 'minor') losses as the liquid flows to the pump inlet. It is a requirement of any pumping system that these reductions in pressure do not bring the liquid to the liquid-vapour saturation curve—i.e. the liquid should remain in a subcooled state—as this would cause a portion of the liquid to vaporise, causing the pump to cavitate.

Even if the liquid is maintained in its subcooled state, a significant reduction in inlet pressure to the pump may cause the pump to operate away from the intended design conditions, affecting the operation of the system.

The system designer must therefore ensure that there is sufficient pressure at the outflow of the tank so that, subtracting pressure losses and accounting for any ingress of heat into the system, the liquid remains in a subcooled state at the pump inlet and the pump operates within intended design conditions. The pressure at the outflow of the tank is equal to the hydrostatic pressure due to the height of the liquid column, plus the vapour pressure in the headspace of the tank.

As the liquid level in the tank drops, so does the hydrostatic pressure. Furthermore, the vapour in the headspace expands to fill the volume above the liquid and the pressure in the headspace drops. In order to maintain the minimum required pressure at the pump inlet, it is necessary to control the pressure in the headspace of the tank.

The pressure in the headspace of a cryogenic storage tank can be controlled by introducing more gas into it. According to the state of the art in bulk cryogenic liquid storage, the additional gas may come from an external source of fluid (e.g. gas) or may be a portion of the fluid that was stored in and then released from the tank. This portion is evaporated and subsequently reintroduced back into the top of the cryogenic storage tank.

WO2014/099203 exemplifies the state of the art and describes a system for storing Liquid Natural Gas (LNG) wherein a portion of high-pressure Liquid Natural Gas is diverted from the outflow of the cryogenic pump to an ambient vaporiser where it is evaporated before being introduced into the headspace of the cryogenic tank to maintain the tank pressure.

Another method is to allow the ingress of heat into the tank so that some of the liquid evaporates and as a result the headspace is pressurised. Since the rate of heat ingress into an insulated tank is slow, this method is usually limited to applications with very low outflow.

US2013/0098070 allows for somewhat higher flow rates by allowing an accelerated ingress of heat into the tank, but in a controlled manner such that the insulation of the tank is not compromised during storage. Heat pipes (thermal bridges) are provided across the walls of the cryogenic storage tank so that ambient heat can enter into the tank by conduction, vaporizing a portion of the liquid cryogen and thus maintaining the desired pressure in the headspace. The area of the heat pipe exposed to the outside ambient air may be adjusted in order to modulate the amount of heat transferred to the liquid cryogen. This design dispenses with the use of the ambient vaporizer without requiring a reduction in outflow. However, this system in itself represents a significant cost for a specially constructed cryogenic tank with the added complexity of controllable heat pipes traversing the walls of the tank.

The high volumetric liquid withdrawal flow rates associated with dispensing operations of Liquid Natural Gas sometimes require the ambient heat exchangers to be very large and costly. U.S. Pat. No. 5,771,946 describes a Liquid Natural Gas dispensing system wherein Liquid Natural Gas is pumped to higher pressure, warmed in a heat exchanger to near the liquid-vapour saturation curve, and dispensed in its liquid form to the cryogenic fuel tank of a vehicle. The document discloses the control of the cryogenic tank headspace by taking a portion of the warmed Liquid Natural Gas downstream of the heat exchanger, expanding it to a lower pressure and introducing it into the top of the tank. Since the liquid is close to the liquid-vapour saturation curve, a portion flashes off and raises the vapour pressure of the tank headspace. This method removes the requirement for an ambient vaporiser.

The common disadvantage of the above methods is the wastage of a portion of cryogen used to pressurise the storage tank, meaning that it cannot usefully be employed.

WO2007/096656 and WO2013/034908 disclose Liquid Air Energy Storage (LAES) systems that exploit the temperature and phase differential between low temperature liquid air and ambient air, or waste heat, to store energy at periods of low demand and/or excess production, allowing this stored energy to be released later to generate electricity during periods of high demand and/or constrained output. The systems comprise a means for liquefying air during periods of low electricity demand (a liquefaction phase), a means for storing the liquid air produced (a storage phase), and a series of expansion turbines for expanding the gaseous air resulting from the pressurisation and subsequent heating of the liquid air (a power recovery phase). The expansion turbines are connected to a generator to generate electricity when required to meet shortfalls between supply and demand.

Ambient air is composed of 79% nitrogen. LAES systems may equally operate using nitrogen as the working fluid where a supply of nitrogen is available. The concepts of the present invention are applicable for LAES systems operating with nitrogen or air. While the composition of the air is nominally the ambient composition (79% nitrogen), the skilled person will recognise that the basis of the invention does not rely upon any particular composition of the components of air. For simplicity, the present description refers to "air" only.

Additionally, WO2013/034908 further discloses the use of a cold store, also referred to as a high grade cold store (HGCS), which stores the cold that is released by the liquid air in the evaporator during the power recovery phase. During the power recovery phase, liquid air from the tank is pumped and directed to an evaporator, where it absorbs heat from a counter-flowing gaseous heat transfer fluid in a cold recovery stream and emerges as gaseous air. The counter-flowing gas is thus cooled. The cooled gas in the cold recovery stream subsequently enters the cold store where the cold embodied in the cooled gas stream is stored. During the liquefaction phase, the cold stored in the cold store is transferred to the liquefier in a cold supply stream and used to increase the amount of liquid air produced by the liquefier per amount of electricity consumed to drive the liquefier compressor. In some embodiments, the cold recovery and/or cold supply streams may be formed of air flowing in a closed loop. In this case, the cold recovery stream, cold supply stream and cold store are hereafter referred to as the cold recycle system. In order to optimise heat transfer characteristics within the cold recycle system, it is preferable to operate at an above-ambient pressure. This is typically up to 10 bar, above which point the cost of the system generally becomes prohibitive due to the increased engineering requirements of containing a large volume at high pressure.

The energy supplied to the LAES system during the liquefaction phase is embodied in the liquid air in the storage tank and recovered in the expansion of the air in the power recovery phase.

A LAES system may be designed to discharge the full capacity of its tanks over just a few hours, meaning that the outflow from the cryogenic storage tanks is particularly high. The state-of-the-art techniques described above present particular problems in this context. Due to the flow rate of vapour needed to pressurise the tank, a very large and costly ambient vaporiser or external gas supply is required. Furthermore, the embodied energy of any portion of cryogen used to pressurise the tank according to the state of the art techniques is wasted.

One of the key parameters of a commercially viable energy storage system is the round-trip efficiency, which represents the portion of the energy input to the system that is recovered following storage. It is desirable to minimise the energy lost throughout the process.

There is therefore a need for a low-cost means of pressurising the cryogenic storage tank in a LAES system with minimal wastage of the energy embodied in the liquid air.

The above problem relates to the reduction in pressure in the storage tank as the liquid level drops during the power recovery phase. Another problem exists during the liquefaction stage when the liquid level in the tank is rising. As the tank is filled, the level of liquid in the tank increases and gas in the tank headspace gradually becomes compressed as it has less volume to occupy. Headspace is the volume remaining in the tank that is not taken up by liquid. To avoid an excessive pressure build-up, the gas in the tank headspace is usually vented to ambient. Venting of potentially useful pressure in the system is wasteful and thus represents inefficiency in the system.

In effect, the liquefaction system is required to compress and purify air for liquefaction. The inventors have realised that by recovering clean, pressurised air from the headspace of the tank, the quantity of atmospheric air to be pressurised and cleaned in the liquefaction system may be reduced.

Other problems arise due to pressure changes in a cryogenic energy storage system during the power recovery and liquefaction stages. For instance, the present inventors have observed that in a cold recycle system of a cryogenic energy storage system, a typical cold store operates between approximately minus 160° C. and ambient temperature. In an ideal gas there is an inverse relationship between temperature and density. For example, at 5 bar, the density of air is approximately two times higher at minus 160 degC than at positive 15 degC. As the cold store is cooled during the power recovery phase and the mean temperature of the thermal storage medium falls, the mean density of the gas heat transfer fluid rises. As a result, the pressure exerted by the fixed mass of gas within the fixed volume of the cold recycle system reduces. The pressure in the cold recycle system should be maintained. Thus, the loss of pressure must somehow be compensated for. Conversely, during the liquefaction phase, the mean temperature of the thermal storage medium rises and the mean density of the gas heat transfer fluid falls, resulting in an increase in the pressure within the fixed volume of the cold recycle system. This is known as thermal expansion. If the pressure in the cold recycle system exceeds a certain threshold, it must be vented. As mentioned above, venting represents a waste of energy and thus inefficiency in the system.

Additionally, the gas heat transfer fluid in the cold recycle system may be lost through small leaks in the system. Over time this may lead to a loss of pressure within the system such that its operating characteristics become detrimentally affected.

In order to address these problems, there is a need for a means of controlling the pressure within a cryogenic liquid storage tank and within a cold recycle system of a LAES system with minimal impact on the round-trip efficiency of the system.

SUMMARY OF THE INVENTION

The present invention relates to improved means for controlling pressure in the cryogenic liquid storage tank and cold recycle system of a Liquid Air Energy Storage System.

The present inventors have realised that the problem of controlling pressure within a cryogenic liquid storage tank for use in a Liquid Air Energy Storage system can be solved at lower cost and greater efficiency compared with the prior art by recycling a small portion of the stream of cryogen to the cryogenic liquid storage tank after regasification and expansion to recover energy. The improvements are particularly beneficial where the flow of liquid out of the tank is such that a disproportionately large and expensive ambient vaporiser would otherwise be needed to re-pressurise the tank. Naturally a skilled person would design any LAES system according to his or her particular requirements, but the present invention is found to be particularly economically beneficial in systems where flow rates from the tank are 15 kg/s or more.

Accordingly, in a first aspect, the present invention provides a cryogenic energy storage system, comprising:

at least one cryogenic fluid storage tank having an output;

a primary conduit through which a stream of cryogenic fluid may flow from the output of the fluid storage tank to an exhaust of the system;

a pump within the primary conduit downstream of the output of the tank for pressurising the cryogenic fluid stream;

evaporative means within the primary conduit downstream of the pump for vaporising the pressurised cryogenic fluid stream;

at least one expansion stage within the primary conduit downstream of the evaporative means for expanding the vaporised cryogenic fluid stream and for extracting work therefrom;

a secondary conduit configured to divert at least a portion of the cryogenic fluid stream from the primary conduit and reintroduce it to the fluid storage tank; and pressure control means within the secondary conduit for controlling the flow of the diverted cryogenic fluid stream and thereby controlling the pressure within the tank; characterised in that:

the secondary conduit is coupled to the primary conduit downstream of one or more of the at least one expansion stages.

By re-pressurising a fluid storage tank using a portion of the cryogenic fluid stream that has been expanded by at least one expansion stage, the round-trip efficiency of the system is improved. In particular, it is not necessary to sacrifice any of the cryogenic fluid stream from which work is extracted in said at least one expansion stage, which may therefore receive substantially all of the cryogenic fluid stream leaving the tank, thus maximising the work that may be extracted by said at least one expansion stage from fluid flowing from the tank. Efficiency gains are realised by diverting the cryogenic fluid stream after just one expansion stage. However, further gains are realised by diverting the stream after more than one (or even all) stages.

The present inventors have also realised that the problem of maintaining pressurisation of a cold recycle system in a Liquid Air Energy Storage system can be solved at lower cost and greater efficiency compared with the prior art by recycling a small portion of the stream of cryogen to the cold recycle system after regasification and expansion to recover energy.

Accordingly, in a second aspect, the present invention provides a cryogenic energy storage system, comprising:

at least one cryogenic fluid storage tank having an output;

a primary conduit through which a stream of cryogenic fluid may flow from the output of the fluid storage tank to an exhaust of the system;

a pump within the primary conduit downstream of the output of the tank for pressurising the cryogenic fluid stream;

evaporative means within the primary conduit downstream of the pump for vaporising the pressurised cryogenic fluid stream;

at least one expansion stage within the primary conduit downstream of the evaporative means for expanding the vaporised cryogenic fluid stream and for extracting work therefrom;

a liquefier for producing cryogen for storage in the cryogenic fluid storage tank;

a cold recycle system comprising a cold store for storing cold energy and pipework coupling the cold store to the evaporative means and to the liquefier for transferring cold energy from the evaporative means to the liquefier via the cold store;

a secondary conduit configured to divert at least a portion of the cryogenic fluid stream from the primary conduit and introduce it to the cold recycle system; and pressure control means within the secondary conduit for controlling the flow of the diverted cryogenic fluid stream and thereby controlling the pressure within the cold recycle system; characterised in that:

the secondary conduit is coupled to the primary conduit downstream of one or more of the at least one expansion stages.

The exhaust of the cryogenic energy storage systems mentioned above refers to a part of the respective system through which the working gas is exhausted into the atmosphere or into another system (e.g. refrigeration system, air-conditioning system) co-located to said respective system.

The pressure control means mentioned above may comprise a valve to control the pressure of a fluid in communication with said valve.

By pressurising a cold recycle system using a portion of the cryogenic fluid stream that has been expanded by at least one expansion stage, the impact on round-trip efficiency of the system is minimised. In particular, it is not necessary to sacrifice any of the cryogenic fluid stream from which work is extracted in said at least one expansion stage, which may therefore receive substantially all of the cryogenic fluid stream leaving the tank, thus maximising the work that may be extracted by said at least one expansion stage from fluid flowing from the tank. Efficiency gains are realised by diverting the cryogenic fluid stream after just one expansion stage. However, further gains are realised by diverting the stream after more than one (or even all) stages.

Moreover, the first and second aspects may be combined; wherein the cryogenic energy storage system of the first aspect also comprises:

a cold recycle system comprising a cold store for storing cold energy; a liquefier for producing cryogen for storage in the cryogenic fluid storage tank; and pipework coupling the cold store to the evaporative means and to the liquefier for transferring cold energy from the evaporative means to the liquefier via the cold store; and a tertiary conduit configured to divert at least a portion of the cryogenic fluid stream from the primary conduit and introduce it to the cold recycle system, thereby increasing the pressure within the cold recycle system; characterised in that:

the tertiary conduit is coupled to the primary conduit downstream of one or more of the at least one expansion stages.

The tertiary conduit may be coupled to the primary conduit downstream of the coupling between the primary conduit and the secondary conduit, or it may be coupled upstream of the coupling between the primary conduit and the secondary conduit, or the tertiary and secondary conduits may be coupled at the same intersection point. It will be appreciated that the further downstream the cryogenic fluid is, the lower its pressure. Whilst the pressure of any diverted fluid in secondary and tertiary conduits will be controlled by pressure control means, it is preferable that the low pressure applications take a portion of the cryogenic fluid stream from a point in the primary conduit that is downstream (and hence at lower pressure) than the location from which a portion of the cryogenic fluid stream is taken for high pressure applications.

Preferably, the evaporative means comprises a heat exchanger, which enables the heat necessary for evaporating the cryogen to be recycled from another process. For instance, the evaporative means may comprise a heat exchanger, which evaporates the cryogen using heat from another part of the cryogenic energy storage system (e.g. cold store when discharged, exhaust of a turbine, compressor of a liquefaction subsystem, heat store) or from another system co-located to said system (e.g. power plants, manufacturing plants and data centers).

The at least one cryogenic fluid storage tank, may be a plurality of cryogenic fluid storage tanks, and the secondary conduit may be coupled to each tank in series or in parallel, or in accordance with any appropriate arrangement. The secondary conduit may be coupled to each tank via a valve, such that one or more of the cryogenic fluid storage tanks may be switched in and out of the system.

The cryogenic energy storage system may further comprise a heating device immediately upstream of the first expansion stage and within the primary conduit. This may be the case where the system comprises just one expansion stage or more than one expansion stage. Moreover, where the at least one expansion stage comprises two or more expansion stages, the system may further comprise a heating device between each pair of adjacent expansion stages and within the primary conduit. The heating device may be a heat exchanger, a source of waste heat, a heater, or any other suitable heating device.

Where the cryogenic energy storage system comprises more than one expansion stage in series, it will necessarily comprise an upstream expansion stage (closer to the tank, and at relatively high pressure) and a downstream expansion stage (further from the tank and at relatively low pressure). In that case, a connection between the primary and secondary conduits is preferably downstream of the downstream expansion stage such that both the upstream and downstream expansions stages receive substantially all of the cryogenic fluid stream leaving the tank, thus maximising the work that may be extracted by said expansion stages from fluid flowing from the tank.

Optionally, the secondary conduit is connected to the primary conduit by at least first and second branches. It will be appreciated that this structure will cause the stream to join from two or more locations along the primary channel via the at least first and second branches. In one arrangement, the connection between the first branch and the primary conduit is between the upstream and downstream expansion stages and the connection between the second branch and the primary channel is downstream of the downstream expansion stage. This enables fluid to be diverted from the primary conduit at two places—one at higher pressure than the other. As explained further below, this is useful where there are different pressure requirements for the diverted fluid, or in response to a change in the pressure available at the connection points.

Where the cryogenic energy storage system comprises first and second expansion stages, a connection between the primary and secondary conduits is preferably downstream of the second expansion stage. Here, 'first' is used to designate the expansion stage that is first encountered by the stream; i.e. the expansion stage closest to the tank and at the highest pressure. 'Second' is used to designate the expansion stage immediately downstream of the first.

In that case, where the secondary conduit is connected to the primary conduit by at least first and second branches, the connection between the first branch and the primary conduit is between the first and second expansion stages and the connection between the second branch and the primary channel is downstream of the second expansion stage.

Optionally, the at least one expansion stage comprises first, second and third expansion stages and a connection between the primary and secondary conduits is between the second and third expansion stages. Here, 'third' is used to designate the expansion stage immediately downstream of the second.

In that case, where the secondary conduit is connected to the primary conduit by at least first and second branches, the connection between the first branch and the primary conduit is preferably between the first and second expansion stages, and the connection between the second branch and the primary conduit is preferably between the second and third expansion stages. It will be appreciated that the connection between the first branch and the primary conduit may instead be between the second and third expansion stages, and the connection between the second branch and the primary conduit may be downstream of the third expansion stage, depending on pressure requirements.

Where the secondary conduit comprises first and second branches, the branches preferably join using valve means configured to selectively connect the first and second branches to the downstream end of the secondary conduit. Thus, the point at which the cryogenic fluid stream is diverted from the primary conduit can be switched, depending on circumstances.

The valve means may comprise a valve.

Preferably, the cryogenic energy storage system comprises:

- an ambient vaporizer coupled to the cryogenic fluid storage tank for controlling the pressure therein; and
- pressure sensing means configured to sense a pressure within the headspace of the tank and a pressure within the primary conduit at the intersection with the secondary conduit; wherein:
- the system is configured to cause the ambient vaporizer to control the pressure within the cryogenic fluid storage tank when the pressure within the primary conduit at the intersection with the secondary conduit is insufficient to pressurise the fluid storage tank.

Thus, whilst the pressure in the primary conduit at the intersection with the secondary conduit is sufficient to re-pressurise the tank, it may do so. Where the pressure in the primary conduit at the intersection with the secondary conduit drops below that sufficient to re-pressurise the tank, an auxiliary pressure supply in the form of an ambient vaporizer may take over.

It will be appreciated that in cases where the secondary conduit comprises first and second branches, the aforementioned intersection of the primary conduit and secondary conduit (i.e. at which there is the pressure sensing means that triggers activation of the ambient vaporiser) may be an intersection of the primary conduit and either the first branch or the second branch of the secondary conduit. Preferably, however, it is the first branch since at this point the pressure will be higher than at the second branch.

The pressure sensing means may comprise a pressure sensor to measure the pressure of a fluid.

The cryogenic energy storage system may further comprise processing means configured to control operation of the aforementioned valve means that selectively connects the first and second branches to the downstream end of the secondary conduit. The purpose of such a valve is to connect the downstream end of the secondary conduit (and thus the tank) with the branch having a pressure which is closest to (but greater than) the pressure in the tank. Optionally, the pressure in the tank may be held constant by a regulating valve that vents overpressure. Accordingly, to effect proper control over the valve, the system may comprise pressure sensing means configured to sense a first pressure within the primary conduit at the intersection with the second branch. Providing the first pressure remains sufficient to pressurise the tank (and is determined to be such either by sensing the pressure in the tank or by virtue of the configuration of the regulating valve), the processing means connects the second branch to the downstream end of the secondary conduit. If the first pressure becomes insufficient to pressurise the tank, the processing means may be configured to connect the first branch to the downstream end of the secondary conduit instead of the second branch. It will be appreciated that with the aforementioned configurations, the first branch is at higher pressure than the second branch.

The processing means may comprise a control system able to take inputs (measured pressure values) from at least one pressure sensing means and to control as a function of said inputs at least one valve means and/or at least one pressure control means.

Optionally, the pressure sensing means may also be configured to sense: a second pressure within the primary conduit at the intersection with the first branch; and/or a pressure within the headspace of the tank.

In any event, the processing means may be configured to cause the valve to connect the downstream end of the secondary conduit to the second branch when the first pressure is higher than the pressure in the headspace of the tank; and cause the valve to connect the downstream end of the secondary conduit to the first branch when the first pressure is equal to or lower than the pressure in the headspace of the tank.

A skilled person will recognise that where this description refers to the pressure at the intersection being higher or lower than the pressure in the headspace of the tank, one must account for the pressure losses in the secondary conduit caused by the pipework and valve means, pressure control means and any other components situated in the secondary conduit. While the pressure at the given intersection point may be slightly higher than the pressure in the headspace of the tank, the pressure drop along the secondary conduit may be such that insufficient flow rate will flow to the tank to maintain the required pressure. The system designer could calculate the corresponding pressure at which this occurs, and/or measure it during commissioning, and configure the system to switch between the first and second branches before the flow rate becomes insufficient.

Thus, the system may divert a portion of the stream of cryogenic fluid at various points along the primary channel and select the most appropriate point based upon the pressures at those points. The skilled person will recognise that there may be more than two connection points, as required.

In the same manner as described above, the tertiary conduit may be split into multiple branches Further valve means and sensing means are preferably provided to select the branch according to pressure requirements.

Optionally, connection between the primary and secondary conduits is immediately upstream of a heating device and immediately downstream an expansion stage. Alternatively, the connection between the primary and secondary conduits is immediately downstream of a heating device and immediately upstream of an expansion stage. Thus, the system may be configured to provide the diverted stream at an appropriate temperature for its intended use.

Optionally, the connection between the primary and secondary conduits is upstream of a heating device and the connection between the primary and tertiary conduits is downstream of said heating device. Alternatively, the connection between the primary and secondary conduits is downstream of a heating device and the connection between the primary and tertiary conduits is upstream of said heating device. Thus, the system may be configured to provide two diverted streams at different temperatures.

In another preferred embodiment, the connection between the primary and tertiary conduits is immediately downstream of a heating device, and the tertiary conduit is coupled to the cold recycle system immediately upstream of the evaporator. The same applies to embodiments in which there is no tertiary conduit and the secondary conduit is coupled to the cold recycle system. Thus, the diverted portion of the cryogenic fluid stream is comparatively hot, and the heat can be utilised in the evaporator/heat exchanger to further improve the round trip efficiency of the system.

In a third aspect there is provided a method of repressurising at least one cryogenic fluid storage tank in a cryogenic energy storage system, comprising:

- passing a stream of cryogenic fluid through a primary conduit from an output in the cryogenic fluid storage tank;
- pressurising the stream of cryogenic fluid with a pump within the primary conduit downstream of the output of the tank;
- vaporising the stream of pressurised cryogenic fluid with an evaporative means within the primary conduit downstream of the pump;
- expanding and extracting work from the stream of vaporised cryogenic fluid with at least one expansion stage within the primary conduit downstream of the pump; and
- diverting at least a portion of the expanded stream of pressurised cryogenic fluid from the primary conduit through a secondary conduit and reintroducing it into the cryogenic fluid storage tank, thereby controlling the pressure within the tank; characterised in that:
- said at least a portion of the expanded stream of pressurised cryogenic fluid is diverted from the primary conduit after the stream has been expanded in one or more of the at least one expansion stages and work has been extracted from it.

In a fourth aspect there is provided a method of pressurising a cold recycle system of a cryogenic energy storage system having a cryogenic fluid storage tank, comprising:

- passing a stream of cryogenic fluid through a primary conduit from an output in the cryogenic fluid storage tank;
- pressurising the stream of cryogenic fluid with a pump within the primary conduit downstream of the output of the tank;
- vaporising the stream of pressurised cryogenic fluid with an evaporative means within the primary conduit downstream of the pump;
- expanding and extracting work from the stream of vaporised cryogenic fluid with at least one expansion stage within the primary conduit downstream of the pump; and
- diverting at least a portion of the expanded stream of pressurised cryogenic fluid from the primary conduit through a secondary conduit and introducing it into the cold recycle system, thereby controlling the pressure within the cold recycle system;

characterised in that:

said at least a portion of the expanded stream of pressurised cryogenic fluid is diverted from the primary conduit after the stream has been expanded in one or more of the at least one expansion stages and work has been extracted from it.

The present inventors have also realised that similar principles may be used to solve the problem of controlling pressure in the cold recycle system and cryogenic storage tank.

Accordingly, a fifth aspect of the invention provides a cryogenic energy storage system, comprising:

a liquefaction subsystem configured to receive a fluid input, the liquefaction subsystem comprising a liquefier configured to produce a liquid cryogen from the fluid input for storage in a cryogenic fluid storage tank;

an energy recovery subsystem configured to receive liquid cryogen from the cryogenic fluid storage tank, the energy recovery subsystem comprising an evaporator configured to vaporise the liquid cryogen from the cryogenic fluid storage tank for delivery to an expansion stage for extracting work from the vaporised liquid cryogen; and a cold recycle subsystem comprising:

a cold store for storing cold energy recovered from the evaporator for delivery to the liquefier; and a cold recycle circuit comprising pipework coupling the cold store to the evaporative means and to the liquefier, and through which one or more cold supply streams may flow for transferring cold energy from the evaporator to the cold store and from the cold store to the liquefier;

characterised by one or both of:

i. a pressure relief conduit coupled between the pipework and the liquefaction subsystem and configured to divert at least a portion of the one or more cold supply streams from the cold recycle loop and introduce it to the liquefaction system; and ii. a pressurisation conduit coupled between the pipework and a fluid supply for introducing fluid to the pipework to pressurise the one or more cold supply streams.

By providing a pressure relief conduit between the cold recycle system and the liquefaction system, the gas released in relieving the pressure build-up due to thermal expansion in the cold recycle system may be used to offset a portion of the energy required to compress the gas to be liquefied rather than being wasted to atmosphere. Thus, the inefficiency associated with venting this gas to atmosphere is eliminated.

By providing a pressurisation conduit between the cold recycle system and a fluid supply, the problem of maintaining pressure in the cold recycle system is overcome. The fluid supply may be any convenient supply, either external to or internal of the cryogenic energy storage system.

Where a pressure relief conduit is provided, the system may further comprise pressure control means within the pressure relief conduit for controlling the flow of the diverted cold supply stream. Thus, the pressure within the pipework of the cold recycle system may be controlled. For example, pressure within the pipework of the cold recycle system may be decreased or increased by increasing or decreasing the rate of flow of the diverted cold supply stream, respectively. As a skilled person would appreciate, pressure in the pipework of the cold recycle system will be maintained providing the pressure decrease associated with diverting the cold supply stream matches the pressure increase associated with thermal expansion, and vice versa.

Where a pressurisation conduit is provided, the system may further comprise pressure control means within the pressurisation conduit for controlling the flow of the introduced fluid. Thus, the pressure within the pipework of the cold recycle system may be controlled. For example, pressure within the pipework of the cold recycle system may be increased and decreased by increasing or decreasing the rate of flow of the introduced fluid, respectively. As a skilled person would appreciate, pressure in the pipework of the cold recycle system will increase providing the pressure increase associated with introducing the fluid exceeds the pressure decrease associated with leaks or with the reduction in fluid pressure owing to drop in temperature.

In one embodiment, the cryogenic energy storage system further comprises a cryogenic fluid storage tank, and the pressurisation conduit is coupled between the pipework of the cold recycle system and the cryogenic fluid storage tank for delivering gas to the pipework of the cold recycle system from the headspace of the cryogenic fluid storage tank. Thus, the cold recycle system may be pressurised using gas from the tank.

In a further embodiment, the cryogenic energy storage system further comprises a primary conduit through which a stream of cryogenic fluid may flow from the output of the cryogenic fluid storage tank to an exhaust of the cryogenic energy storage system, and the pressurisation conduit is coupled between the pipework of the cold recycle system and the primary conduit for delivering gas to the pipework of the cold recycle system from the primary conduit. Thus, the cold recycle system may be pressurised using gas from the primary conduit, preferably downstream from at least one expansion stage such that gas is delivered after regasification and expansion to recover energy, as described in connection with the first embodiment.

Of course, the cryogenic energy storage system may comprise two pressurisation conduits (i.e. a first and a second); one which is coupled between the pipework of the cold recycle system and the primary conduit for delivering gas to the pipework of the cold recycle system from the primary conduit and one which is coupled between the pipework of the cold recycle system and the cryogenic fluid storage tank for delivering gas to the pipework of the cold recycle system from the headspace of the cryogenic fluid storage tank.

Preferably, the pressure relief conduit is coupled to the pipework of the cold recycle system downstream of the liquefier and upstream of the cold store, such that the at least a portion of the one or more cold supply streams is diverted after it has transferred cold energy from the cold store to the liquefier. Thus, the usefulness of the cold supply stream in delivering cold energy is retained before it is diverted.

Preferably, the pressurisation conduit connects the pipework of the cold recycle system and the cryogenic storage tank and the pressurisation conduit is coupled to the pipework of the cold recycle system downstream of the evaporator and upstream of the cold store, such that gas delivered from the cryogenic fluid storage tank joins the cold supply stream before the cold supply stream has transferred cold energy from the evaporator to the cold store. In this case, it is preferable for the gas from the cryogenic storage tank to contain high-grade cold, which may thus be transferred to the liquefaction system. High grade cold is defined as cold at a temperature close to that supplied by the evaporator. If the high-grade cold is at a higher temperature than the temperature supplied by the evaporator, it will dilute the cold. Preferably, the high-grade cold is at a temperature no more than a few degrees Celsius higher than the temperature supplied by the evaporator. More preferably, the high-grade cold is at a temperature that is lower than the temperature supplied by the evaporator, and will serve to slightly enhance the cold supplied by the evaporator.

Preferably the liquefaction system comprises a first compressor and a second compressor downstream of the first compressor, and further comprises an air purification unit between the first and second compressors. In that case, the pressure relief conduit may be coupled to the liquefaction system between the first and second compressors, downstream of the air purification unit.

In one embodiment, the pressure control means is configured to limit the pressure in the cold recycle system to a threshold pressure. In that case, the liquefaction system may comprise one of:

- a plurality of compressors, each having an inlet pressure; and
- a multistage compressor having a plurality of stages, each having an inlet pressure;

and wherein

- the pressure relief conduit is coupled to the liquefaction system immediately upstream of the compressor or compressor stage having the inlet pressure closest to but less than the threshold pressure.

In accordance with a sixth aspect of the invention, there is provided a cryogenic energy storage system, comprising:

- at least one cryogenic fluid storage tank having a liquid output and a gas output;
- a liquefaction system comprising at least one compressor coupled to a liquefier for producing cryogen for storage in the cryogenic fluid storage tank;
- a liquid delivery conduit coupled between the liquefier and the cryogenic fluid storage tank for conveying cryogen from the liquefier to the fluid storage tank; and
- a displaced gas conduit coupled between the gas output of the fluid storage tank and the liquefaction system for conveying gas displaced from the fluid storage tank by the cryogen to the liquefaction system.

In accordance with a seventh aspect of the invention, there is provided a cryogenic energy storage system, comprising:

- at least one cryogenic fluid storage tank having a liquid output and a gas output;
- a liquefaction system comprising at least one compressor coupled to a liquefier for producing cryogen for storage in the cryogenic fluid storage tank;
- a liquid delivery conduit coupled between the liquefier and the cryogenic fluid storage tank for conveying cryogen from the liquefier to the fluid storage tank;
- a cold recycle system comprising a cold store and a cold recycle circuit comprising pipework coupling the cold store to the liquefier, and through which one or more cold supply streams may flow for transferring cold energy from the cold store to the liquefier;
- first and second displaced gas conduits for conveying gas displaced from the fluid storage tank by the cryogen to the liquefaction system, wherein the first displaced gas conduit is coupled between the gas output of the fluid storage tank and the pipework of the cold recycle system and wherein the second displaced gas conduit is coupled between the pipework of the cold recycle system and the liquefaction system.

By providing a connection between the cryogenic fluid storage tank and the liquefaction system, the gas displaced from the fluid storage tank by the cryogen may be used to offset a portion of the energy required to compress the gas to be liquefied rather than being wasted to atmosphere.

Preferably the first gas displacement conduit is connected to the pipework of the cold recycle system downstream of the cold store and upstream of the liquefier, such that gas delivered from the cryogenic fluid storage tank joins the cold supply stream before the cold supply stream has transferred cold energy from the cold store to the liquefier.

Preferably the cryogenic storage system further comprises pressure control means within the displaced gas conduit for controlling the flow of the gas displaced from the fluid storage tank by the cryogen and thereby controlling the pressure within the cryogenic fluid storage tank. For example, pressure within the cryogenic fluid storage tank may be increased or decreased by increasing or decreasing the rate of flow of the displaced gas, respectively. As a skilled person would appreciate, pressure in the tank will be maintained providing the pressure decrease associated with displacing the gas matches the pressure increase associated with the introduction of fluid to the tank, and vice versa. Where the cryogenic storage system comprises first and second gas displacement conduits, preferably the pressure control means is within the first gas displacement conduit.

Preferably, the liquefaction system comprises a first compressor and a second compressor downstream of the first compressor, and further comprises an air purification unit between the first and second compressors. The displaced gas conduit may be coupled to the liquefaction system between the first and second compressors, downstream of the air purification unit.

In one embodiment, the pressure control means is configured to limit the pressure in the cryogenic fluid storage tank to a threshold pressure; and the liquefaction system comprises one of:

- a plurality of compressors, each having an inlet pressure; and
- a multistage compressor having a plurality of stages, each having an inlet pressure; and wherein
- the displaced gas conduit is coupled to the liquefaction system immediately upstream of the compressor or compressor stage having the inlet pressure closest to but less than the threshold pressure.

It will be appreciated that the fifth aspect can be combined with the sixth and/or seventh aspects, such that the liquefaction system receives both (i) gas released in relieving the pressure build-up due to thermal expansion in the cold recycle system (according to the fifth aspect); and (ii) gas displaced from the fluid storage tank by the cryogen (according to the sixth and/or seventh aspects).

According to the fifth, sixth and seventh aspects, the invention achieves a reduction in the electrical work required by the main air compressor and the air purification unit, as they will have to compress and clean a proportionately smaller quantity of gas ambient air (since they are supplied with a stream of clean and pressurised gas from the cold recycle system and/or the cryogenic fluid storage tank).

According to an eighth aspect there is provided a method of controlling pressure in a cold recycle system of a cryogenic energy storage system comprising: a liquefaction system having a liquefier, an energy recovery system having an evaporator, and a cold recycle system having a cold store and a cold recycle circuit having pipework coupling the cold store to the evaporator and to the liquefier, the method comprising:

- passing a cold supply stream through pipework of the cold recycle system between the cold store and the liquefier and thereby transferring cold energy from the cold store to the liquefier and heating the cold supply stream; and diverting at least a portion of the heated cold supply stream from the pipework of the cold recycle system through a pressure relief conduit and introducing it into the liquefaction system, thereby venting the pressure in the cold recycle system.

According to a ninth aspect there is provided a method of controlling pressure in a cold recycle system of a cryogenic energy storage system comprising: a liquefaction system having a liquefier, an energy recovery system having an evaporator, and a cold recycle system having a cold store and a cold recycle circuit having pipework coupling the cold store to the evaporator and to the liquefier, the method comprising:

passing a cold supply stream through pipework of the cold recycle system between the evaporator and the cold store and thereby transferring cold energy from the evaporator to the cold store to the liquefier and cooling the cold supply stream; and introducing fluid to the pipework of the cold recycle system through a pressurisation conduit, thereby adding to the pressure in the cold recycle system.

According to a tenth aspect there is provided a method of controlling pressure in a cryogenic fluid storage tank of a cryogenic energy storage system, the tank having a liquid output and a gas output, the method comprising:

passing a stream of cryogenic fluid through a primary conduit from the liquid output of the cryogenic fluid storage tank to an exhaust of the system;

liquefying air in a liquefaction system comprising a liquefier to generate a cryogen;

passing the cryogen through a first conduit from the liquefaction system to the cryogenic fluid storage tank; and conveying gas displaced from the cryogenic fluid storage tank by the cryogen through a displaced gas conduit from the gas output of the cryogenic fluid storage tank to the liquefaction system.

BRIEF DESCRIPTION OF THE DRAWINGS

The present invention shall now be described with reference to the accompanying drawings in which.

DETAILED DESCRIPTION

The pressures, temperatures and flow rates used in the following description are intended to illustrate the invention. A person skilled in the art will understand that a wide range of possible values of pressure, temperature and flow rates exist depending on the particular design of the power recovery part of the LAES system.

At supercritical pressures the distinction between liquid and gaseous phases is not definite. Purely for ease of understanding, the fluid state from the outlet of the evaporator will be described herein as being in the gaseous phase.

Figure 1:
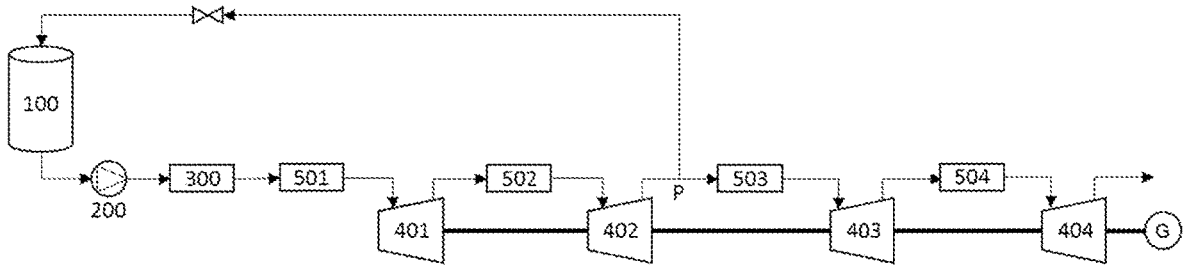
FIG. 1 is a system diagram of a cryogenic energy storage system according to a first embodiment of the invention.

A first embodiment of the invention is shown in FIG. 1, which illustrates a power recovery unit of a LAES system. According to this embodiment, cryogenic liquid is stored in cryogenic storage tank 100 with a pressure of approximately 8 bar in the headspace of the tank.

During a first power recovery period cryogenic liquid stored in cryogenic storage tank 100 is withdrawn from the bottom of tank 100 at a rate of 100 kg/s and pumped to a pressure of 100 bar in cryogenic pump 200. The resulting high-pressure cryogenic liquid is then substantially vaporised in evaporator 300, emerging as a gaseous stream, at a temperature of approximately 15 degC. Said gaseous stream is then further heated in first heating device 501 to a temperature of 80 degC before being expanded in first expansion stage 401 to a pressure of approximately 32 bar. The gaseous stream is now at a temperature of approximately 0 degC and is reheated in second heating device 502 to 80 degC before entering second expansion stage 402. The gaseous stream emerges at a pressure of approximately 10 bar and a temperature of approximately 0 degC. Downstream of expansion stage 402 (specifically, between the second and third expansion stages), at connection point P, a portion of the gaseous stream is diverted, forming a pressurisation stream.

The remainder of the gaseous stream has a flow rate that is, on average (during the power recovery phase), approximately 98% of the flow rate of the original gaseous stream prior to diversion. This remainder is reheated to 80 degC in third heating device 503 before entering third expansion stage 403 from which emerges at a pressure of approximately 4 bar and a temperature of approximately 0° C. The remainder of the gaseous stream is reheated to 80 degC in fourth heating device 504 before entering fourth expansion stage 404 where it is expanded to approximately ambient pressure before being exhausted to atmosphere. In this case, connection point P is immediately upstream of the third heating device 503 (between the second expansion stage 402 and the third heating device 503).

First, second, third and fourth expansion stages 401, 402, 403 and 404 are mechanically coupled to an electric generator such that the work generated by expansion of the gaseous stream in first, second, third and fourth expansion stages 401, 402, 403 and 404 is converted into electrical energy.

The pressurisation stream has a flow rate that is, on average, approximately 2% of the flow rate of the original gaseous stream prior to diversion. The pressurisation stream is connected to the headspace of cryogenic storage tank 100 via pressure control means 600. Pressure control means 600 is configured to regulate the pressure in the headspace of the cryogenic tank at a constant 8 bar.

During a second power recovery period, in response to a change in electrical load, the output of the system is decreased to approximately 85% of capacity by reducing the discharge pressure of the cryogenic pump to approximately 48 bar (according to techniques known in the art). The rate of outflow of liquid from tank 100 drops to approximately 85 kg/s and the reheat temperatures remain identical. The outlet pressure from expansion second stage 402 is now approximately 8.5 bar.

During this second power recovery period, the rate of outflow from the tank is lower than during the first power recovery period and the required flow of the pressurisation stream is also lower. Since the pressurisation stream is diverted from the gaseous stream, the ratio of the flow rates of the outflow of liquid from the tank and the pressurisation stream are approximately the same during the first and second periods of power recovery.

It will be recognised that during the second power recovery period, the pressure available in the pressurisation stream is approaching the pressure in tank 100. The system is therefore approaching a limit beyond which it would no longer be possible to pressurise tank 100 as the pressure differential would cause vapour to flow in reverse from tank 100 to connection point P downstream of second expansion stage 402. While the addition of non-return valve means would prevent reverse flow, it would not be possible to pressurise tank 100 from the gaseous stream. Advantageously, connection point P is provided at a point in the system where the pressure remains above the minimum required tank pressure over the entire range of output required of the system. This point will depend on various system parameters and may be tailored to suit particular circumstance by a skilled person.

Alternatively, the system may further comprise a small ambient vaporiser coupled to the tank for maintaining the pressure in the headspace of the tank during the LAES storage phase when the power recovery unit is not running. In this case, when the pressure at connection point P drops below the pressure in the tank during the power recovery period, since the outflow from the tank will be lower, it may be practicable to use the small ambient vaporiser to maintain tank headspace pressure for the lower end of the output range. Suitable sensing and control means may be provided to achieve this, as a skilled person would appreciate.

It is known in the art of cryogenic liquid storage that the boil-off rate of a liquefied gas is lower at low pressure. Optionally, during the storage phase, cryogenic storage tank 100 may be held at lower headspace pressure, for example 4 bar, to reduce the quantity of gas lost to boil-off, and, during the power recovery phase, the pressure may be raised using the above described system to the operating pressure (in this case 8 bar). This would have the effect of sub-cooling the fluid by taking it away from the saturation curve, providing greater available NPSH to the cryogenic pump.

Figure 11:
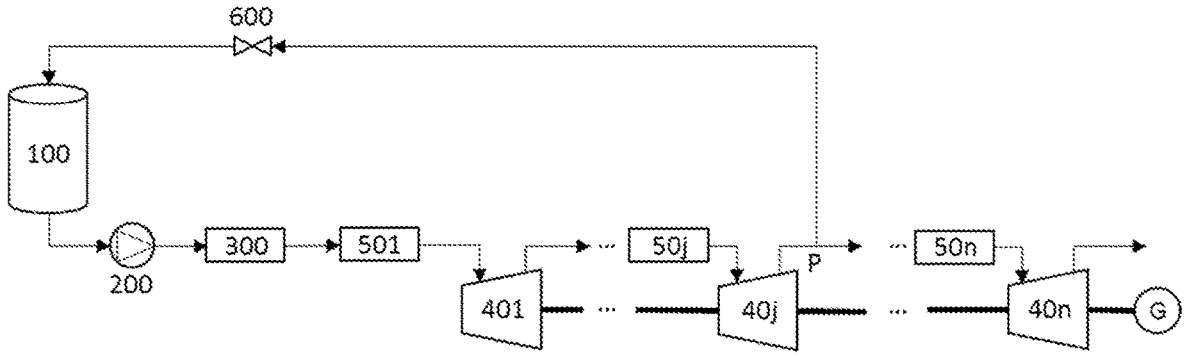
FIG. 11 is a system diagram showing possibilities for cryogenic energy storage systems according to further embodiment of the invention.

A person skilled in the art will recognise that the system may comprise any number of expansion stages and that connection point P may be situated downstream of one or more of the stages, provided that the pressure at point P is greater than or equal to the required pressure in the cryogenic storage tank. In the case where only one expansion stage is provided, connection point P may be situated downstream of the expansion stage; that is, between the expansion stage and the exhaust of the system. However, in that case it would be necessary for the exhaust of the system be at a pressure greater than or equal to the required pressure in the cryogenic storage tank. Preferably, the connection point P is immediately downstream of the expansion stage; that is, without any other components in between. Where there are two or more expansion stages, connection point P may be situated between any two adjacent stages or between the final stage and the exhaust of the system. Specifically, the connection point P may be situated between the first and second expansion stages; or between the second and third expansion stages; and so on. For example, in the embodiment shown in FIG. 1, the pressurisation stream is diverted from the outlet of the second expansion stage 402 but this is simply an exemplary arrangement. The power recovery unit may have at least one and as many as "n" expansion stages, and the pressurisation stream may be diverted from the outlet of any of the said "n" expansion stages, provided that the pressure at the outlet of expansion stage "n" is equal to or higher than the pressure in the cryogenic storage tank 100. FIG. 11 shows a generic representation of embodiments formed by "n" expansion turbines, n being equal or higher than 1, where the stream is diverted from the outlet of turbine "j", j being equal or higher than 1 and equal or lower than n.

Furthermore, it will be understood that cryogenic storage tank 100 may be formed of a plurality of cryogenic storage tanks with a common connection to cryogenic pump 200 and a common header in fluid communication with the fluid connection.

Figure 2:
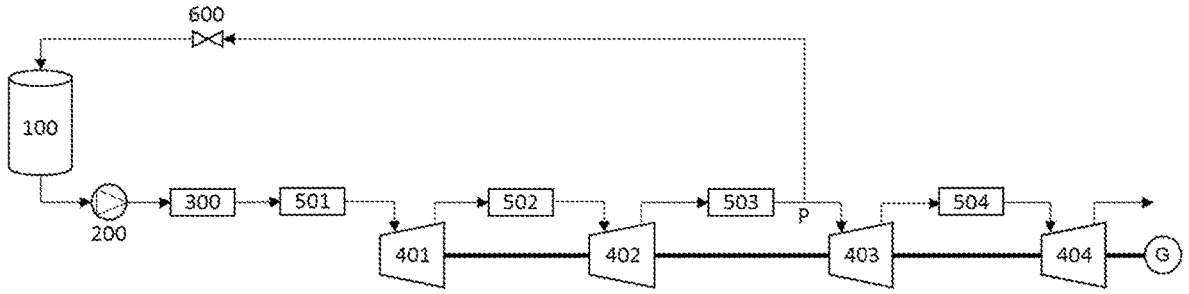
FIG. 2 is a system diagram of a cryogenic energy storage system according to a second embodiment of the invention.

A second embodiment of the invention is shown in FIG. 2 and is identical to the first embodiment except that connection point P is situated downstream of expansion stage 402 (specifically, between the second and third expansion stages) but downstream (rather than upstream) of third heating device 503 (specifically, between the third heating device 503 and the third expansion stage 403). Compared with the first embodiment, the pressurisation stream is at an elevated temperature of 80 degC.

The warmer pressurisation stream is less dense and occupies more space per unit mass, meaning that the same pressure may be achieved in the tank headspace using a smaller quantity of gas as compared with the first embodiment. A portion of the warm gas will condense at the surface of the liquid in the tank, thus forming a layer of saturated liquid in equilibrium with the vapour phase, which is maintained by thermal stratification and provides a barrier between the vapour in the headspace and the bulk of the liquid.

This method may also provide for faster pressurisation of the tank, which could be useful in cases where the cryogenic liquid is stored in the tank at lower pressure and then its pressure is raised at the start of the power recovery phase. Optionally, the system would operate in the manner of the second embodiment during start-up of the power recovery unit in order to provide faster start, and then operate in the manner of the first embodiment once the pressure had been raised to the required operating pressure for the power recovery phase. This could be achieved by providing two connection points (for instance, one upstream of the heating device 503 and one downstream of the heating device 503), in a similar fashion to embodiments discussed below.

It should be understood that, as with the embodiment of FIG. 1, the embodiment of FIG. 2 is merely exemplary, and the same invention can be implemented with the power recovery unit having at least one and as many as "n" expansion stages, and the pressurisation stream may be diverted from a heating device downstream the outlet of any of the said "n" expansion stages, provided that the pressure at the outlet of expansion stage "n" is equal or higher to the pressure in the cryogenic storage tank 100.

Figure 3:
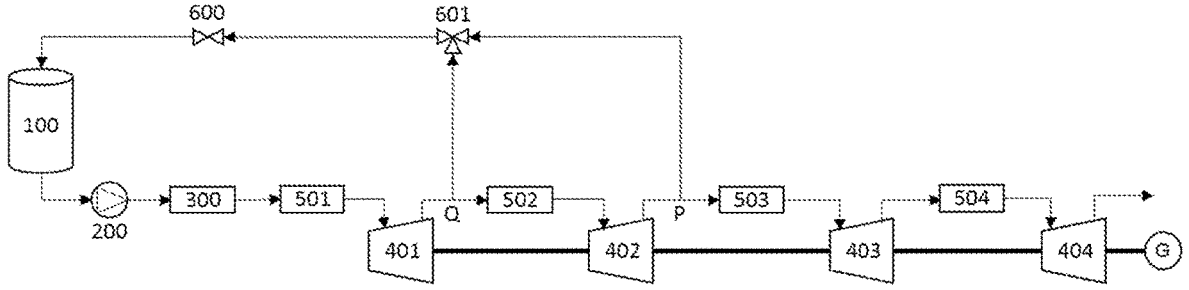
FIG. 3 is a system diagram of a cryogenic energy storage system according to a third embodiment of the invention.

A third embodiment of the invention is shown in FIG. 3 and is identical to the first embodiment except that the fluid connection between the headspace of tank 100 and the gaseous stream is connected at two connection points P and Q rather than one. As shown, connection point Q is between the first expansion stage 401 and the second expansion stage 402; whilst connection point P is between the second expansion stage 402 and the third expansion stage 403. In this case, each connection point is upstream of the heating device that is situated between the same two adjacent stages as the connection point. However, one or more of the connection points may be downstream of the heating device that is situated between the same two adjacent stages as the connection point.

Valve means 601 is provided to alternatively connect either connection point P or connection point Q to the headspace of tank 100 via pressure control means 600. A skilled person would appreciate that where circumstances render it impractical to provide a single pressure control means covering the full range of pressures in the two branches connected at P and Q, two pressure control means may be used—one for each branch.

The advantage of this third embodiment is that if the pressure at point P falls below the pressure in the headspace of tank 100 due to a reduction in the power output of the system, connection point Q, which is at a higher pressure, may be selected instead. Suitable sensing and control means may be provided to achieve this, as a skilled person would appreciate. In circumstances in which the pressure at connection point P is sufficient, however, this connection point may be selected such that further work may be extracted from the gaseous stream before a portion is diverted to the pressurisation stream.

As is common practice in the safe design of all cryogenic energy storage systems, the pressure in the tank of all the above embodiments may be prevented from rising above design value by means of a pressure relief valve (not shown).

A person skilled in the art will understand that the above-described embodiments are purely exemplary arrangements that depict implementations of the invention. The number of expansion stages, the pressures ratios and the temperatures at the inlet of the turbines are design parameters that may vary depending on the particular implementation whilst still falling within the scope of the claims. Moreover, the pressure ratio in each turbine may or may not be the same in all of the stages. Similarly, the inlet temperature at the entrance of each expansion stage may or may not be the same.

Figure 4:
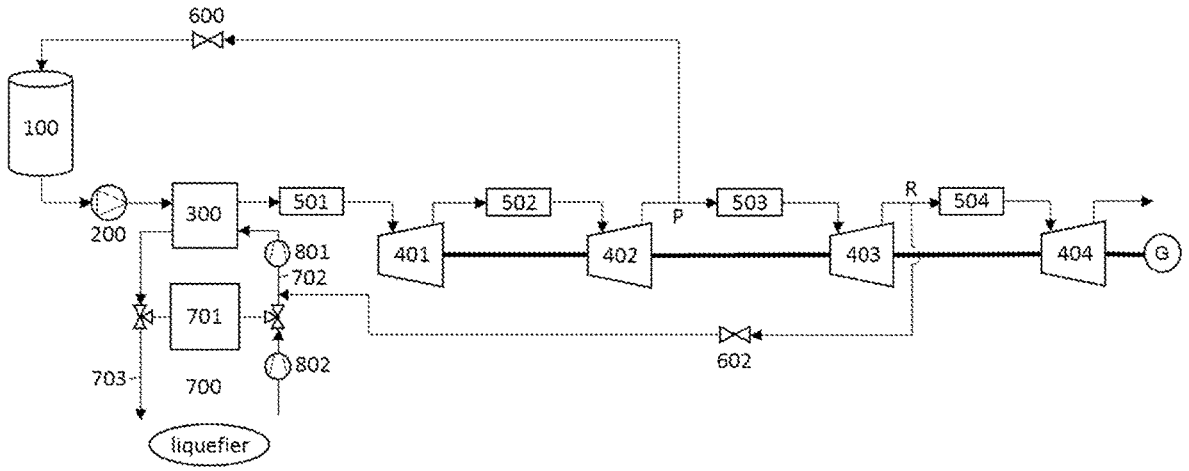
FIG. 4 is a system diagram of a cryogenic energy storage system according to a fourth embodiment of the invention.

A fourth embodiment is shown in FIG. 4. This embodiment is identical to the first embodiment with the exception that an additional fluid connection R is provided downstream of the third expansion stage 403 (specifically, between the third and fourth expansion stages), which provides a pressurisation stream to a cold recycle system 700, comprising cold store 701, cold recovery stream 702 flowing through evaporator 300 and cold supply stream 703 for supplying cold to the liquefier in the LAES system during the LAES charging phase (not shown).

In the exemplary embodiment of FIG. 4, the cold recycle system is maintained at a pressure of 3.5 bar. The fluid connection R is used to maintain the pressure in the cold recycle system. The circulation of gas in the cold recycle system may be ensured by blowers. The flow rate diverted to the cold recycle system is controlled by pressure control means 602 which is configured to open once pressure in the cold recycle system falls below a predetermined threshold, thus allowing the pressure in the cold recycle system to be controlled at the desired level, compensating for the effects of small leaks or thermal contraction as the mean temperature of the fluid in the cold recycle system falls, for instance. Suitable pressure sensing and control means may be provided to achieve this, as a skilled person would appreciate.

In this embodiment, the connection between the conduit carrying the diverted cryogen and the cold recycle system 700 is provided upstream of the blower 801. The portion of cryogen that is diverted at point R is at 0 degC. The gas circulating in cold recycle system 700 emerges from cold store 701 at approximately ambient temperature. It is beneficial to provide the connection upstream of the blower such that the diverted cryogen can provide a slight cooling effect on the gas circulating in the cold recycle system 700, thus reducing the work required to circulate the fluid in blower 801.

The flow required to control the pressure in the cold recycle system depends on the volume of the the cold store, which in turn depends on the energy capacity (MWh) and the operating regime of the LAES system. Compared with utilising the present invention to pressurise a cryogenic storage tank, the gain in useful energy output from the LAES system that results from pressurising the cold recycle system in the manner described above may be small where the cold store is small. This is due to the small flow of the cold recycle pressurisation stream, compared with the higher flow of the cryogenic tank pressurisation stream.

Nevertheless, even marginal gains contribute to the overall round-trip efficiency of the LAES system, and in the case of pressurising the cold recycle system, the gains outweigh the costs of providing the requisite infrastructure of additional pipework and a pressure control system. This is particularly so when pressurisation for the tank is also being provided, but may also be the case in isolation of such a system.

Connection points R and P might be the same connection point along the main fluid stream. In that case, the diverted stream is further split into two separate streams, one of them fluidly connected with the headspace of the cryogenic tank 100 and the other with the cold recycle system 700. The pressure of each stream is accurately controlled by a pressure control means.

Figure 5:
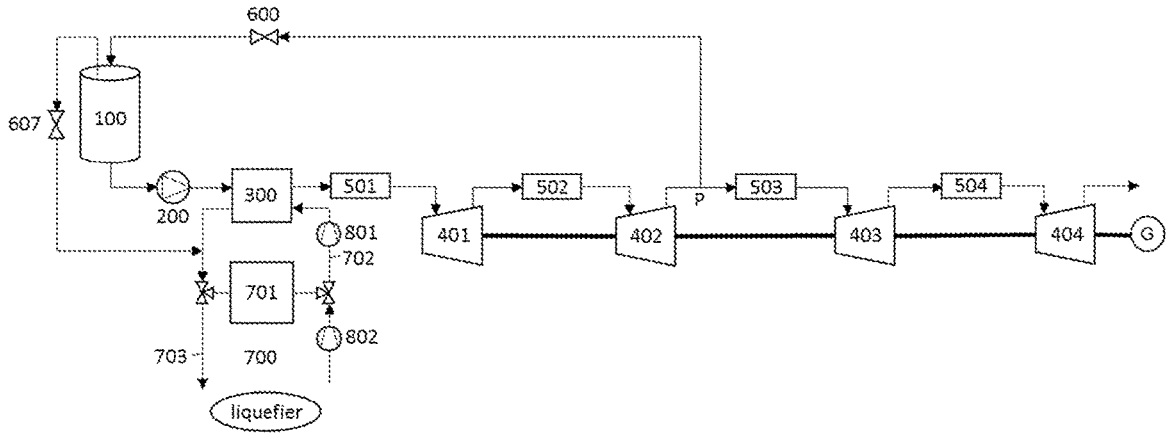
FIG. 5 is a system diagram of a cryogenic energy storage system according to a fifth embodiment of the invention.

A fifth embodiment is shown in FIG. 5. It is identical to the fourth embodiment except that the connection point R is replaced with a connection to the headspace of the cryogenic storage tank and the connection to cold recycle system 700 is provided downstream of the evaporator and upstream of cold store 701. This embodiment is particularly advantageous in cases where cold recycle system 700 operates at the same or slightly lower pressure than the cryogenic storage tank. The cold recycle system 700 is pressurised using gaseous cryogen from the cryogenic tank 100. This embodiment provides for controlling the pressure of cold recycle system 700 during the power recovery phase but also during the storage phase. In the latter case, it may replace gas lost through small leaks in the system. Pressure control means 607 is provided to control the pressure in the cold recycle system.

In this embodiment, the portion of cryogen diverted to cold recycle system 700 leaves the headspace of the cryogenic storage tank at approximately −160 degC. It is therefore beneficial to introduce it to cold recycle system 700 immediately upstream of cold store 701 such that the cold embodied in it is transferred to the thermal storage medium.

Figure 6:
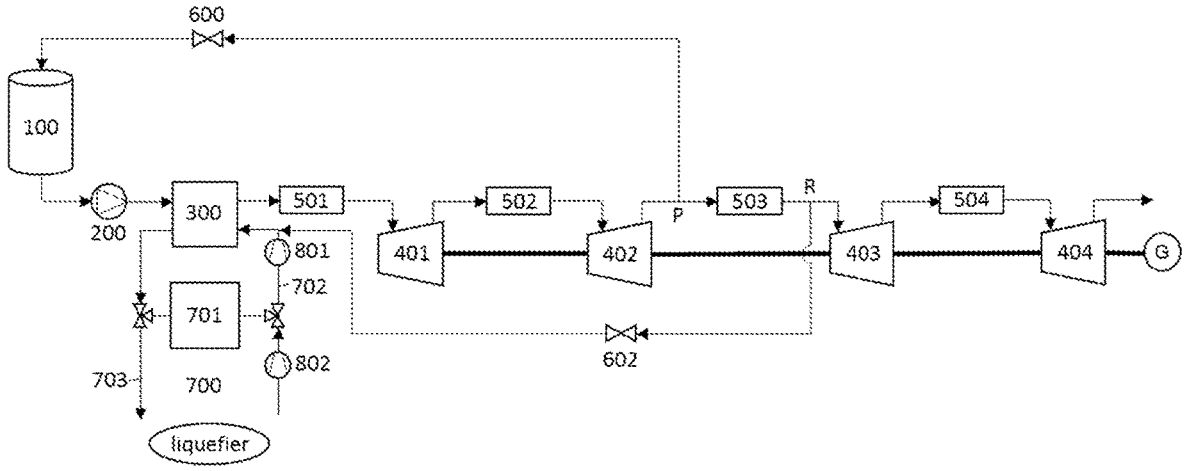
FIG. 6 is a system diagram of a cryogenic energy storage system according to a sixth embodiment of the invention.

A sixth embodiment is shown in FIG. 6. This is identical to the fourth embodiment with the following exceptions.

Firstly, the fluid streams diverted from connection points R and P in the sixth embodiment are at the same pressure but have different temperatures. Secondly, the connection point between the conduit carrying the diverted cryogen and the cold recycle system 700 is provided downstream of cold store 701 and also downstream of the blower 801 (whilst remaining upstream of evaporator 300). In this exemplary embodiment the cold recycle system operates at approximately 8.5 bar and connection points P and R are both downstream of the same expansion stage (in this case, the second expansion stage 402—that is, they are both between the second and third expansion stages). However, connection point P is upstream of heating device 503 whereas connection point R is downstream of heating device 503. In this case, both diverted streams have a pressure around 10 bar, but the stream headed to the cryogenic tank headspace is at a temperature of 0° C. whereas the stream directed to the cold recycle system is at 80° C. Topping up the cold recycle system 700 with a higher temperature stream may enhance evaporation.

It should be understood that the described embodiments are just exemplary arrangements of the invention. The same invention may be implemented having one or more fluid connections between the headspace of the cryogenic tank 100 and a point in the main flow stream downstream at least a first expansion stage 401 and/or one or more fluid connections between the main flow stream downstream the evaporator 300 and the cold recycle system 700. In all cases, the condition is that the pressure of the diverted stream or streams is equal or higher to the target pressure.

Figure 7:
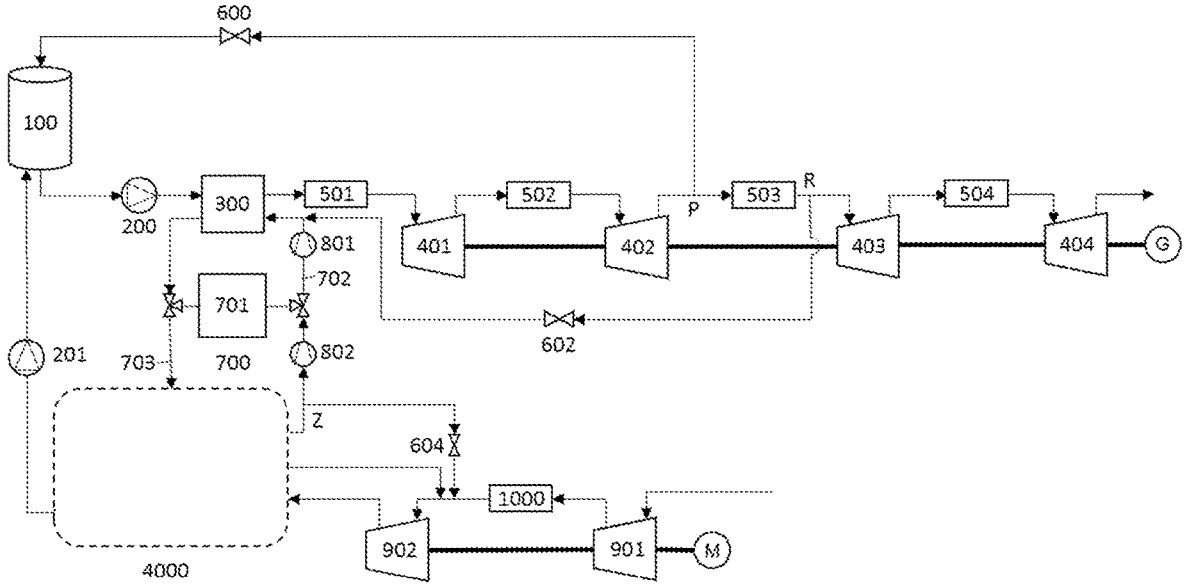
FIG. 7 is a system diagram of a cryogenic energy storage system according to a seventh embodiment of the invention.

A seventh embodiment of the invention is shown in FIG. 7. The seventh embodiment is identical to the sixth except that a connection is provided between cold recycle system 700 and the air liquefaction system. Accordingly, FIG. 7 further illustrates the air liquefaction system, wherein, during the liquefaction phase, ambient air is compressed to approximately 8 bar in compressor 901 before being purified of moisture and other impurities in air purification unit 1000. The now clean air joins air vapour returning from liquefier 4000 before being further compressed in compressor 902 to approximately 60 bar before entering liquefier 4000. A portion of the air is liquefied and sent to cryogenic storage tank 100 via pump 201 while a portion returns to the inlet of compressor 902 During the liquefaction stage cold is being delivered from cold store 701 to liquefier 4000 via cold supply stream 703. The cold supply stream 703 enters liquefier 4000 at around minus 160 degC and leaves it at close to ambient temperature. As result, the mean temperature in cold recycle system 700 gradually increases from approximately minus 160 degC towards ambient. As the air in cold recycle system 700 expands, a portion is relieved via connection point Z and introduced into the air liquefaction system, upstream of compressor 902, where the process pressure is approximately 8 bar. Pressure control means 604 is provided so that when the pressure in the cold recycle loop 700 increases above 8.5 bar, air is diverted from the cold recycle system 700 to the inlet of the recirculating air compressor 902. The advantage of this aspect of the current invention is that instead of venting the clean and compressed air, it is fed into the liquefaction cycle, reducing the duty of the main air compressor 901 and the air purification unit 1000.

As a person skilled in the art will know, the main air compressor 901 and the recirculation air compressor 902 are usually composed of various stages in an arrangement known as multistage compression. Thus, the connection point to the recirculation air compressor 902 will preferably be provided at the inlet of the stage whose inlet pressure is the closest, but inferior, to the pressure in the cold recycle system 700.

Figure 8:
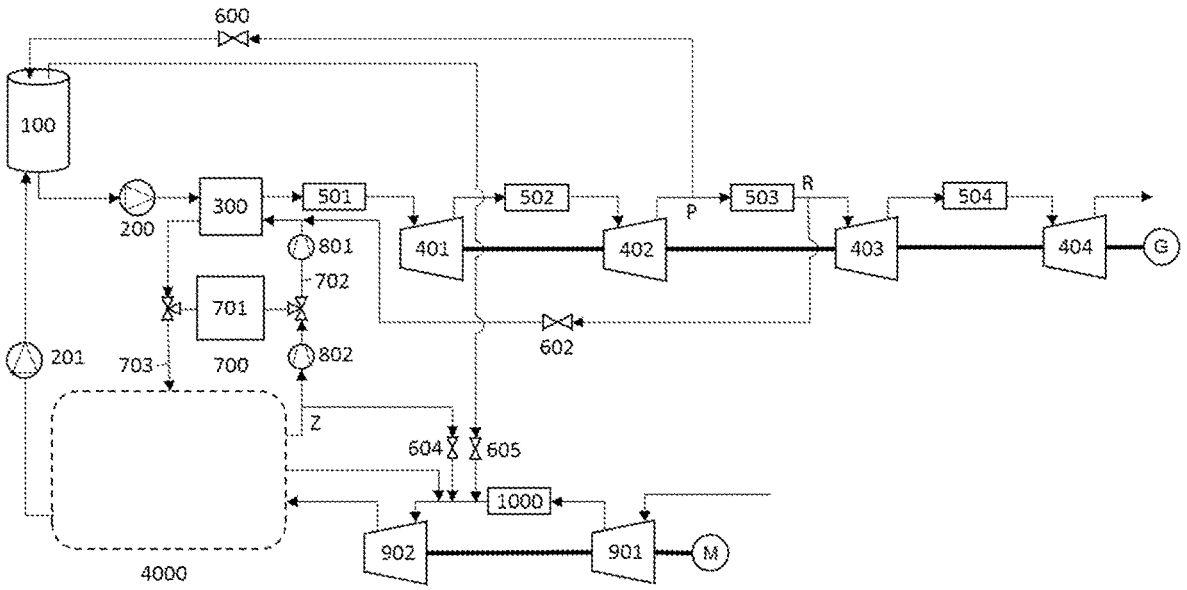
FIG. 8 is a system diagram of a cryogenic energy storage system according to an eighth embodiment of the invention.

An eighth embodiment of the invention is shown in FIG. 8. It is identical to the seventh embodiment except that the same principle is applied to the control of the pressure in the headspace of the cryogenic storage tank during the liquefaction phase. Accordingly, a further connection is provided between the headspace of cryogenic storage tank 100 and the inlet of compressor 902. During the liquefaction phase, as cryogenic storage tank 100 is filled, the level of liquid in the tank increases and gas in the tank headspace gets gradually compressed as it has less volume to occupy. To avoid an excessive pressure build-up, said gas in the tank headspace is usually vented to ambient. The embodiment of FIG. 8 provides a means to avoid wasting that portion of clean and compressed gas by providing a fluid connection to the inlet of the recirculation air compressor 902. This way, the round trip efficiency of the system is increased, even if marginally, as the main air compressor and air purification system need to compress and clean a relatively smaller amount of gas. Pressure control means 605 is provided to the control the pressure in the headspace of the tank.

Figure 9:
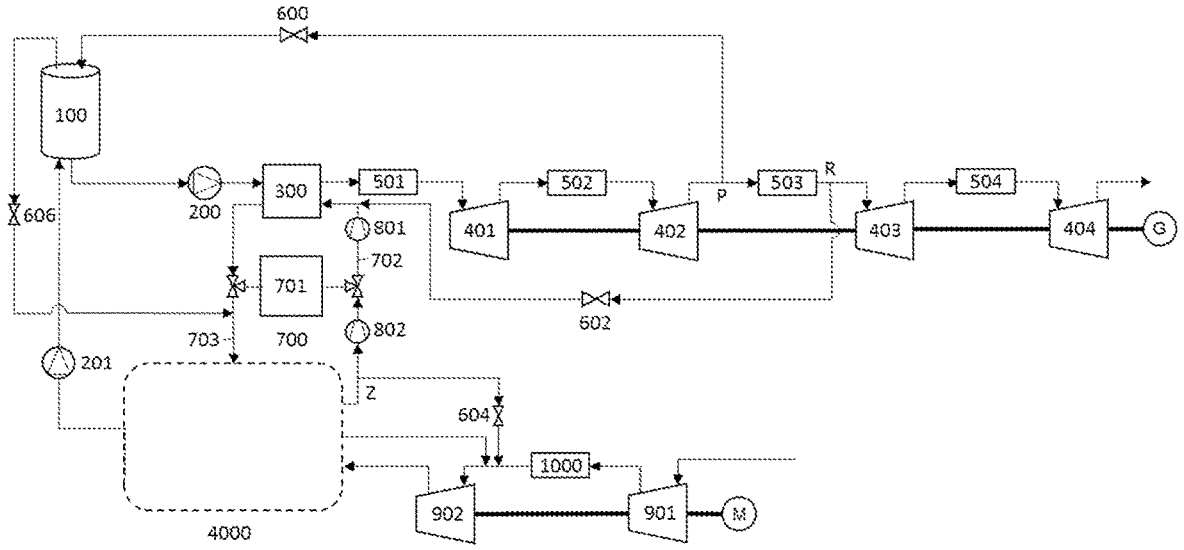
FIG. 9 is a system diagram of a cryogenic energy storage system according to a ninth embodiment of the invention.

A ninth embodiment of the invention is shown in FIG. 9. It is identical to the eighth embodiment except that the fluid connection from the headspace of the cryogenic storage tank is connected to cold supply stream 703 of cold recycle system 700 instead of the inlet of the recirculation air compressor 902. This allows the cold embodied in the vapour released from the headspace of the cryogenic tank to be utilised for cooling in the air liquefier, before being introduced to the inlet of compressor 902 via the same connection provided for the control of pressure in cold recycle system 700 during the liquefaction phase, as explained above in connection with FIG. 7. Pressure control means 606 is provided to control the flow of displaced gas from the cryogenic storage tank to the cold recycle system, thus controlling the pressure in the headspace of the tank. Pressure control means 606 controls the pressure in the headspace of the cryogenic storage tank to slightly above the pressure in the cold recycle system as controlled by pressure control means 604, such that the flow of gas is always from the cryogenic storage tank to the cold recycle system to the liquefaction system.

Figure 10:
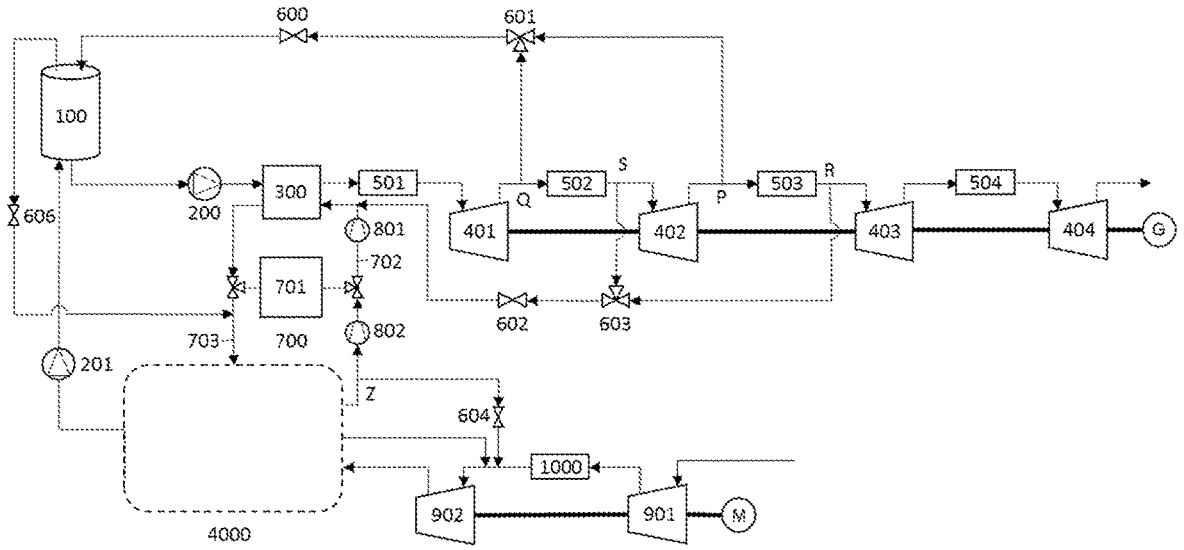
FIG. 10 is a system diagram of a cryogenic energy storage system according to a tenth embodiment of the invention.

A tenth embodiment of the invention is shown in FIG. 10. It is identical to the ninth embodiment except that the fluid connection between the headspace of tank 100 and the gaseous stream is connected at two connection points P and Q rather than one and the fluid connection between the cold recycle system and the gaseous stream is connected at two points R and S, and valve means 601 and 603 are provided for selecting between connection points P and Q, and connection points R and S respectively.

The advantage of this tenth embodiment is that if the pressures at points P or R fall below the pressure in the headspace of tank 100 or the pressure of cold recycle system 700 respectively, due to a reduction in the power output of the system, connection points Q or S respectively, which are at a higher pressure respectively, may be selected instead.

It should be understood that the described embodiments are just exemplary arrangements of the invention. The same invention may be implemented using any combination of connections, including: between the cryogenic tank and the liquefaction system; between the cold recycle system and the liquefaction system; and between the cryogenic tank and the cold recycle system (with or without a subsequent connection between the cold recycle system and the liquefaction system). There may also be provided a connection between the cryogenic tank and the cold recycle system upstream of the cold store; and/or a connection between the cryogenic tank and the cold recycle system downstream of the cold store (again either with or without a subsequent connection between the cold recycle system and the liquefaction system).

Irrespective of such modified embodiments, the invention is defined solely by the appended claims.

The invention claimed is:

1. A cryogenic energy storage system, comprising:

at least one cryogenic fluid storage tank having an output;

a primary conduit through which a stream of cryogenic fluid may flow from the output of the fluid storage tank to an exhaust of the cryogenic energy storage system;

a pump within the primary conduit downstream of the output of the tank for pressurising the cryogenic fluid stream to form a pressurised cryogenic fluid stream;

evaporative means within the primary conduit downstream of the pump for vaporising the pressurised cryogenic fluid stream to form a gaseous stream of a vaporised cryogenic fluid stream;

two or more expansion stages in series within the primary conduit downstream of the evaporative means for expanding the vaporised cryogenic fluid stream and for extracting work therefrom;

a heating device between a or each pair of adjacent expansion stages in series and within the primary conduit, wherein the or each pair of adjacent expansion stages comprises an upstream expansion stage and a downstream expansion stage;

a secondary conduit configured to divert at least a portion of the cryogenic fluid stream from the primary conduit and reintroduce it to the fluid storage tank; and pressure control means within the secondary conduit for controlling the flow of the diverted cryogenic fluid stream and thereby controlling the pressure within the tank;

wherein the secondary conduit is coupled to the primary conduit downstream of one or more of the two or more expansion stages;

wherein a connection between the primary and secondary conduits is immediately upstream of a heating device and immediately downstream of the upstream expansion stage in at least one pair of adjacent expansion stages, or a connection between the primary and secondary conduits is immediately downstream of a heating device and immediately upstream of the downstream expansion stage in at least one pair of adjacent expansion stages.

2. The cryogenic energy storage system of claim 1, further comprising:

a cold recycle system comprising a cold store for storing cold energy; a liquefier for producing cryogen for storage in the cryogenic fluid storage tank; and pipework coupling the cold store to the evaporative means and to the liquefier for transferring cold energy from the evaporative means to the liquefier via the cold store; and a tertiary conduit configured to divert at least a portion of the cryogenic fluid stream from the primary conduit and introduce it to the cold recycle system, thereby increasing the pressure within the cold recycle system;

wherein the tertiary conduit is coupled to the primary conduit downstream of one or more of the at least one expansion stages.

3. The cryogenic energy storage system of claim 1, wherein the evaporative means comprises a heat exchanger, wherein the pressure control means within the secondary conduit comprises a valve, wherein the at least one cryogenic fluid storage tank is a plurality of cryogenic fluid storage tanks, and further comprising a heating device immediately upstream of the first expansion stage and within the primary conduit.

4. The cryogenic energy storage system of claim 1, further comprising an additional connection between the primary and secondary conduits downstream of the downstream expansion stage in the at least one pair of adjacent expansion stages.

5. The cryogenic energy storage system of claim 1, wherein the two or more expansion stages in series comprise first and second expansion stages, the secondary conduit is connected to the primary conduit by first and second branches, and wherein the connection between the first branch and the primary conduit is between the first and second expansion stages, and wherein the connection between the second branch and the primary conduit is downstream of the second expansion stage.

6. The cryogenic energy storage system of claim 1, wherein the two or more expansion stages in series comprises first, second and third expansion stages in series and a connection between the primary conduit and the secondary conduit is between the second and third expansion stages.

7. The cryogenic energy storage system of claim 6, wherein the secondary conduit is connected to the primary conduit by first and second branches, and wherein the connection between the first branch and the primary conduit is between the first and second expansion stages, and wherein the connection between the second branch and the primary conduit is between the second and third expansion stages.

8. The cryogenic energy storage system of claim 7, wherein the first and second branches of the secondary conduit join at a valve configured to selectively connect the first and second branches to the downstream end of the secondary conduit.

9. The cryogenic energy storage system of claim 1, further comprising:

an ambient vaporizer coupled to the cryogenic fluid storage tank for controlling the pressure therein; and pressure sensing means configured to sense a pressure within a headspace of the tank and a pressure within the primary conduit at an intersection with the secondary conduit; wherein:

the system is configured to cause the ambient vaporizer to control the pressure within the cryogenic fluid storage tank when the pressure within the primary conduit at the intersection with the secondary conduit is insufficient to pressurise the fluid storage tank.

10. The cryogenic energy storage system of claim 9, wherein the two or more expansion stages in series comprises first, second and third expansion stages in series, wherein the secondary conduit is connected to the primary conduit by first and second branches, and wherein the connection between the first branch and the primary conduit is between the first and second expansion stages, and wherein the connection between the second branch and the primary conduit is downstream of the second expansion stage, and wherein said intersection of the primary conduit and secondary conduit is an intersection of the primary conduit and the first branch of the secondary conduit.

11. The cryogenic energy storage system of claim 8, further comprising processing means configured to control operation of the valve; and pressure sensing means configured to sense: a first pressure within the primary conduit at the intersection with the second branch; optionally, a second pressure within the primary conduit at the intersection with the first branch; and, optionally, a third pressure within the headspace of the tank; and wherein the processing means is configured to:

cause the valve to connect the downstream end of the secondary conduit to the second branch when the first pressure is determined to be sufficient to pressurise the fluid storage tank; and cause the valve to connect the downstream end of the secondary conduit to the first branch when the first pressure is determined to be insufficient to pressurise the fluid storage tank.

12. The cryogenic energy storage system of claim 1, wherein a connection between the primary and secondary conduits is immediately downstream of a heating device and immediately upstream of the downstream expansion stage in at least one pair of adjacent expansion stages.

13. A method of re-pressurising at least one cryogenic fluid storage tank in a cryogenic energy storage system, comprising:

passing a stream of cryogenic fluid through a primary conduit from an output in the cryogenic fluid storage tank;

pressurising the stream of cryogenic fluid with a pump within the primary conduit downstream of the output of the tank to form a pressurised cryogenic fluid stream;

vaporising the stream of pressurised cryogenic fluid with an evaporative means within the primary conduit downstream of the pump to form a gaseous stream of a vaporised cryogenic fluid stream;

expanding and extracting work from the gaseous stream of the vaporised cryogenic fluid with two or more expansion stages in series within the primary conduit downstream of the pump;

heating the expanded cryogenic fluid stream with a heating device between a or each pair of adjacent expansion stages in series within the primary conduit, wherein the or each pair of adjacent expansion stages comprises an upstream expansion stage and a downstream expansion stage; and diverting at least a portion of the expanded stream of pressurised cryogenic fluid from the primary conduit through a secondary conduit and reintroducing it into the cryogenic fluid storage tank, thereby controlling the pressure within the tank;

wherein said at least a portion of the expanded stream of pressurised cryogenic fluid is diverted from the primary conduit after the stream has been expanded in one or more of the two or more expansion stages and work has been extracted from it;

wherein a connection between the primary and secondary conduits is immediately upstream of a heating device and immediately downstream of the upstream expansion stage in at least one pair of adjacent expansion stages; or a connection between the primary and secondary conduits is immediately downstream of a heating device and immediately upstream of the downstream expansion stage in at least one pair of adjacent expansion stages.

14. The cryogenic energy storage system of claim 5, wherein the first and second branches of the secondary conduit join at a valve configured to selectively connect the first and second branches to the downstream end of the secondary conduit.

15. The cryogenic energy storage system of claim 1, wherein the primary conduit is further configured to convey a remaining portion of the stream of cryogenic fluid in gaseous form from the point at which the secondary conduit is coupled to the primary conduit to the exhaust of the cryogenic energy storage system.

16. The method of claim 13, further comprising conveying a remaining portion of the expanded stream of pressurised cryogenic fluid in gaseous form from the point at which the secondary conduit is coupled to the primary conduit to an exhaust of the cryogenic energy storage system.

17. The method of claim 13, wherein substantially all of the cryogenic fluid stream from the output of the fluid storage tank is conveyed in the primary conduit through the pump and the evaporative means and at least a first of the two or two or more expansion stages in series.

18. The cryogenic energy storage system of claim 1, wherein the primary conduit is configured to convey substantially all of the cryogenic fluid stream from the output of the fluid storage tank through the pump and the evaporative means and to a first of the least two or more expansion stages in series.

* * * * *